US009267344B2

(12) United States Patent
Alhaug et al.

(10) Patent No.: US 9,267,344 B2
(45) Date of Patent: Feb. 23, 2016

(54) ACTUATOR FOR DUAL DRILL STRING VALVE AND DRILL STRING VALVE CONFIGURATIONS THEREFORE

(75) Inventors: Espen Alhaug, Stavanger (NO); Stein Erik Meinseth, Stavanger (NO)

(73) Assignee: Reelwell A.S., Stavanger (NO)

( * ) Notice: Subject to any disclaimer, the term of this patent is extended or adjusted under 35 U.S.C. 154(b) by 928 days.

(21) Appl. No.: 13/406,931

(22) Filed: Feb. 28, 2012

(65) Prior Publication Data

US 2013/0220622 A1 Aug. 29, 2013

(51) Int. Cl.

| | |
|---|---|
| ***E21B 34/14*** | (2006.01) |
| ***E21B 34/10*** | (2006.01) |
| ***E21B 21/10*** | (2006.01) |
| ***E21B 21/12*** | (2006.01) |

(52) U.S. Cl.
CPC ..... *E21B 21/10* (2013.01); *E21B 21/12* (2013.01); *E21B 34/14* (2013.01)

(58) Field of Classification Search
CPC ..... E21B 34/14; E21B 34/10
See application file for complete search history.

(56) References Cited

U.S. PATENT DOCUMENTS

| | | | | |
|---|---|---|---|---|
| 2,831,539 | A | 4/1958 | En Dean et al. | |
| 3,268,017 | A | 8/1966 | Yarbrough | |
| 6,827,158 | B1 | 12/2004 | Dimitroff et al. | |
| 7,017,682 | B2 * | 3/2006 | Chan et al. | 175/57 |
| 7,090,033 | B2 * | 8/2006 | Chan et al. | 175/25 |

OTHER PUBLICATIONS

Notification of Transmittal of the International Search Report and the Written Opinion of the International Searching Authority, PCT/EP2013/052312, Mar. 12, 2014.

* cited by examiner

*Primary Examiner* — Catherine Loikith
(74) *Attorney, Agent, or Firm* — Richard A. Fagin

(57) ABSTRACT

A dual drill string actuator includes a piston disposed in a housing. The housing is configured to sealingly couple at its longitudinal ends to an end of a nested dual drill string segment. An upper internal conduit is mounted in the housing proximate one longitudinal end thereof. A lower internal conduit is mounted in the housing proximate the other longitudinal end thereof. The piston is slidably, sealingly engaged between the upper and lower inner conduits and together define an internal fluid flow passage therethrough. The upper inner conduit, the piston and the lower inner conduit also define an external flow passage between respective exterior surfaces thereof and an interior of the housing such that application of fluid pressure to the external flow passage causes movement of the piston.

11 Claims, 8 Drawing Sheets

ACTUATOR FOR DUAL DRILL STRING VALVE AND DRILL STRING VALVE CONFIGURATIONS THEREFORE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

The invention relates generally to the field of dual drill pipe strings. More specifically, the invention relates to an actuator and a valve system and configurations of a valve system used with dual drill strings.

It is known in the art of subsurface wellbore drilling to use a single pipe string, two parallel pipes or two nested or concentric pipe strings. Concentric or nested pipe strings refer to a string consisting of inner pipe joints arranged within outer pipe joints connected end to end.

In concentric or nested drill strings, the inner pipe forms part of a flow bore extending from the surface to a drill bit at the lower end of the drill string. An annulus between the outer pipe and inner pipe forms part of a second flow bore extending from the surface to the drill bit. Further, it is known to provide barriers or valves (e.g., check valves) in the pipe string to prevent gas-kicks, blow-outs etc. to move to the surface during drilling operations. Drilling operations may refer to the drilling of a wellbore, including the connection and disconnection of pipe segments (joints or multiple joint "stands") during drilling operations. The barriers may be in the form of valves in the flow bores, arranged to provide seals against uncontrolled flow, such as gas-kicks and blow-outs. The valves may be check valves allowing flow in one direction and preventing flow in the other direction.

The term "drilling" as used herein should be understood to refer to creation of a hole in the subsurface by means of the pipe string. It particularly applies for drilling in the crust of the earth for petroleum recovery, tunnels, canals or for recovery of geothermal energy, both offshore and onshore.

U.S. Patent Application Publication No. 2010/0116501 A1 discloses a backup safety flow control system for concentric drill strings. The '501 publication shows a primary annulus shutoff valve assembly and a backup annulus shutoff valve assembly in the annular bore, and a primary inner bore shutoff valve assembly in the inner bore. In addition, in case the primary inner bore shutoff valve assembly fails, the flow control system includes a backup inner bore shutoff valve by means of a valve that may be dropped from the surface through the inner bore. When the wellbore pressure is brought under control, the drill string can be removed from the well so that the backup inner shutoff valve may be removed.

What is needed is a valve system for use with dual drill strings that can provide a backup flow control.

SUMMARY

One aspect of the invention is a dual drill string actuator including a piston disposed in a housing. The housing is configured to sealingly couple at its longitudinal ends to an end of a nested dual drill string segment. An upper internal conduit is mounted in the housing proximate one longitudinal end thereof. A lower internal conduit is mounted in the housing proximate the other longitudinal end thereof. The piston is slidably, sealingly engaged between the upper and lower inner conduits and together define an internal fluid flow passage therethrough. The upper inner conduit, the piston and the lower inner conduit also define an external flow passage between respective exterior surfaces thereof and an interior of the housing such that application of fluid pressure to the external flow passage causes movement of the piston. Other aspects and advantages of the invention will be apparent from the description and claims which follow.

DETAILED DESCRIPTION

Figure 1:
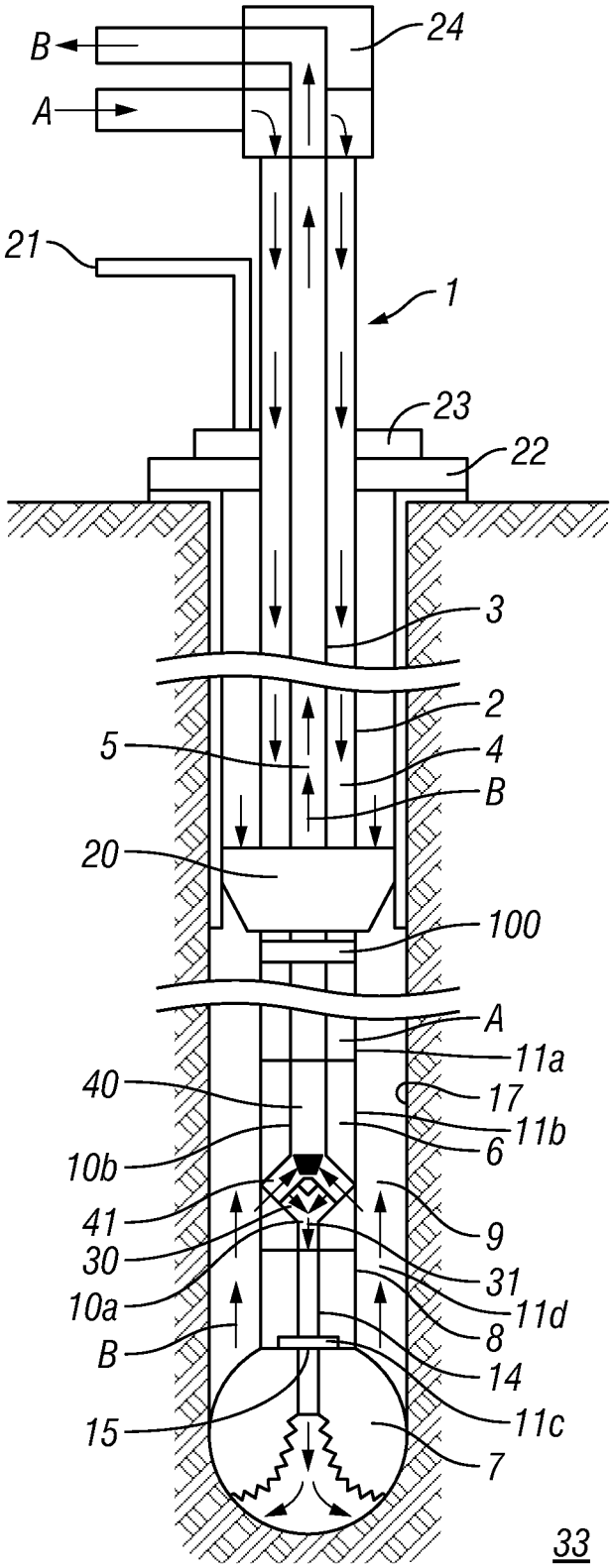
FIG. 1 shows an example drilling arrangement using a nested or concentric drill pipe string and drill string valves.

In FIG. 1 a nested or concentric dual drill string 1 is shown inserted in a wellbore 17 being drilled through subsurface formations 33. The wall of the wellbore 17 creates an annular space (well annulus 9) between the exterior of the dual drill string 1 and the wall of the wellbore 17. The dual drill string 1 may comprise a dual bore drill pipe consisting of an inner pipe 3 arranged within an outer pipe 2. A supply flow of drilling fluid (e.g., "drilling mud"), shown at A, is introduced through a suitable swivel 24 such as a top drive into an annular bore ("fluid supply flow passage") 4 disposed between the inner pipe 3 and the outer pipe 2. The supply flow of drilling fluid A may be ultimately directed to a drill bit 7 that cuts the formations 33. A return flow of drilling fluid, shown at B is transported from the bottom of the wellbore 17 in an inner bore ("return fluid passage") 5 within the inner pipe 3.

In the example shown in FIG. 1, the dual drill string 1 may be arranged with a piston 20 fixed to the dual drill string 1 and in sealing contact with the wall of the wellbore 17. The swivel 24 (if a top drive is used) may also rotate or drive the dual drill string 1. A blow out preventer (BOP) 22 and a rotating control device (RCD) 23 may be arranged at the top of the wellbore 17. By the arrangement of the RCD 23 and piston 20, an isolated space is provided in the upper part of the wellbore 17. In the present example, a fluid may be introduced through a fluid inlet 21 into the isolated space. The introduced fluid provides a pressure to the piston 20, thereby forcing the piston 20 and the dual drill string 1 downwards when drilling is performed. As will be appreciated by those skilled in the art, other arrangements than the piston 20 shown in FIG. 1 may be used for providing a driving force to the dual drill string 1, or may be omitted, wherein the isolated space in the wellbore annulus 9 is closed by the BOP 22 and RCD 23. Thus, the use of the piston 20 in the wellbore annulus 9 is not a limitation on the scope of the invention.

The dual drill string 1 is typically arranged with a flow diverter 6 at a lowe4r end thereof connected to a bottom hole assembly (BHA) 8 holding the bit 7 at a lower end portion of the drill string. The bottom hole assembly (BHA) 8 may a standard type BHA that can be used with conventional (single flow bore) drill pipe and drilling tools, including, without limitation, hydraulic (mud) motors, drill collars, measurement and/or logging while drilling tools. The BHA may also be a reverse flow type such as used in air drilling mining operations. The flow diverter 6 has a flow passage assembly 10*a* providing a fluid connection between the fluid supply flow passage 4 of the dual drill string 1 and a channel 14 or channel assembly of the BHA 8. The channel 14 of the BHA 8 is shown in the example of FIG. 1 with the shape of an axial bore, and the flow passage assembly 10*a* is shown with essentially a Y-shape in an axial cross section. First diverging branches 30 of the Y fit in connection with the fluid supply flow passage 4, and an axial passage part 31 corresponds to the stem portion of the Y and fits in connection with the axial shaped channel 14 of the BHA. The supply flow A exits from the channel 14 into the BHA 8 and thence into the cutting area of the drill bit 7.

From the drill bit 7, the return fluid flow B moves in the well annulus 9 into a return flow passage assembly 10*b* arranged in the flow diverter 6. The axial cross section of a return flow passage assembly 10*b* also has a Y shape with second diverging branches 41 opening at one end into the well annulus 9 and an axial passage part 40 connected with the fluid return flow passage 5. The return flow B enters the inlet of the flow diverter return flow passage 10*b* and returns in the fluid return flow passage 5 of the dual string 1.

The dual drill string 1 may be arranged, for example, with a selected number of valve elements (four shown in the present example), although the number of such valves and their placement within the drill string is not intended to limit the scope of the invention. Two of the valve elements may be arranged for closing and opening of the fluid supply flow A, and two of the valve elements may be arranged for closing and opening of the fluid return flow B. By such arrangement of valve elements, a double barrier system may be provided both for the control of the fluid supply flow A and for control of the fluid return flow B. The closing of the valve elements may be performed, in some examples automatically if the drilling system needs to close down, and in case of emergency, for example, a kick or other unwanted well fluid control conditions. Other examples of valve elements, to be described in more detail below, may close both the fluid supply flow passage 4 and the return fluid passage 5.

In FIG. 1 example locations of the four valve elements are shown schematically. Two bottom valves 11*c*, 11*d* provided for opening and closing the supply flow A, may be located in the bottom hole assembly 8. The bottom valves 11*c*, 11*d* may be positioned to open and close the channel 14, and one of the bottom valves, e.g., 11*d*, may be positioned to control the opening and closing of the outlet 15 of the channel 14. The other bottom valve 11*c* may be positioned upstream along the channel 14 within the bottom hole assembly 8. The bottom valves 11*c*, 11*d* may be conventional drill string check valves as are used with single bore drill string components. Upper valves 11*a*, 11*b* may be positioned in the dual drill string 1. The upper valves 11*a*, 11*b*, may be specifically configured to connect within a nested dual drill string, for example, one shown in U.S. Pat. No. 3,208,539 issued to Henderson, and the valves 11*a*, 11*b* may be referred to hereinafter for convenience as dual drill string valves.

Figure 2A:
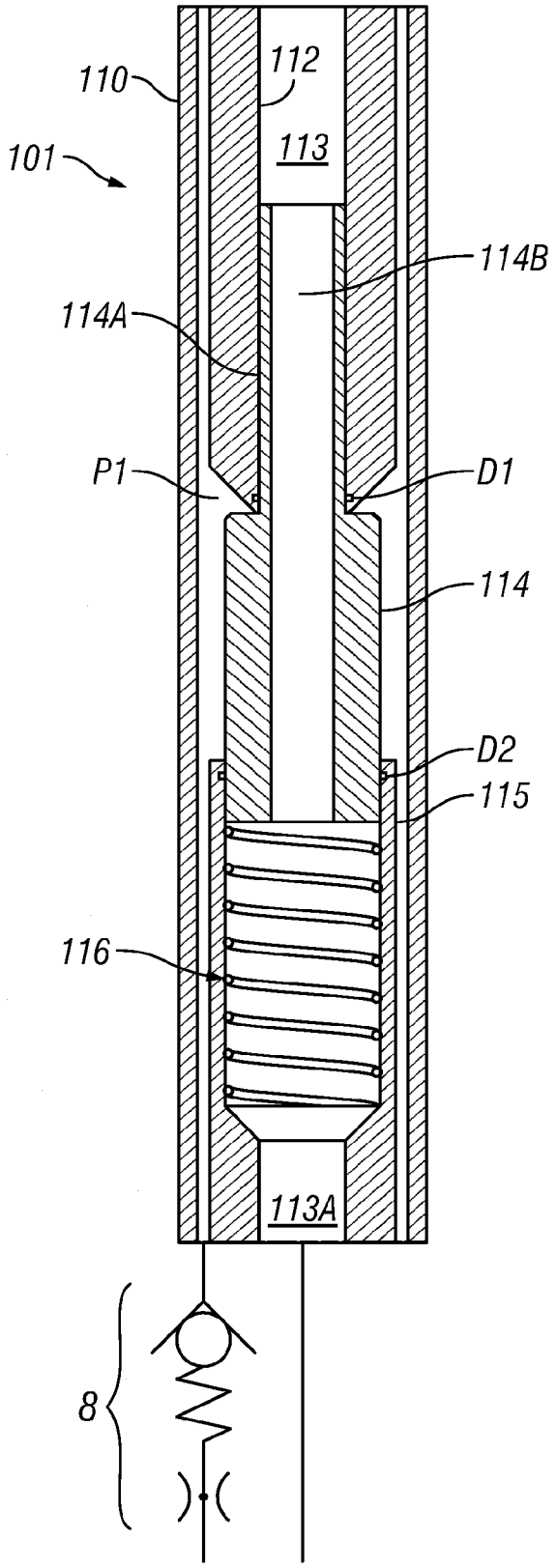
FIGS. 2A through 2D show cut away views of an actuator, and various examples of a dual drill string valve assembly, in the closed (or deactivated) position.
Figure 2B:
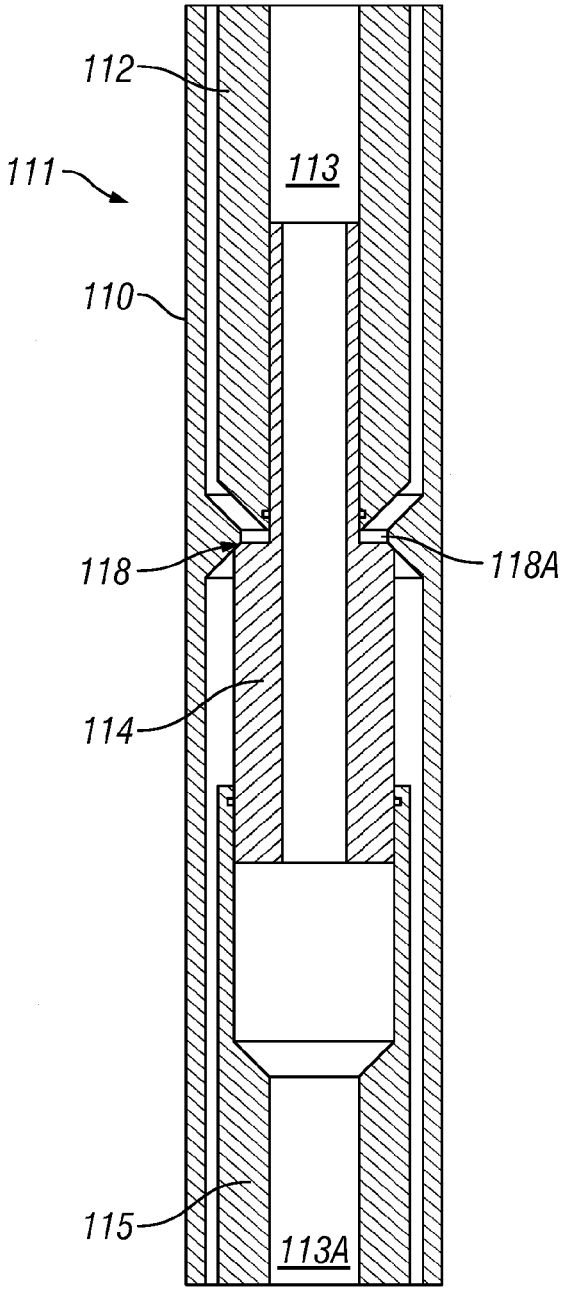
Figure 2C:
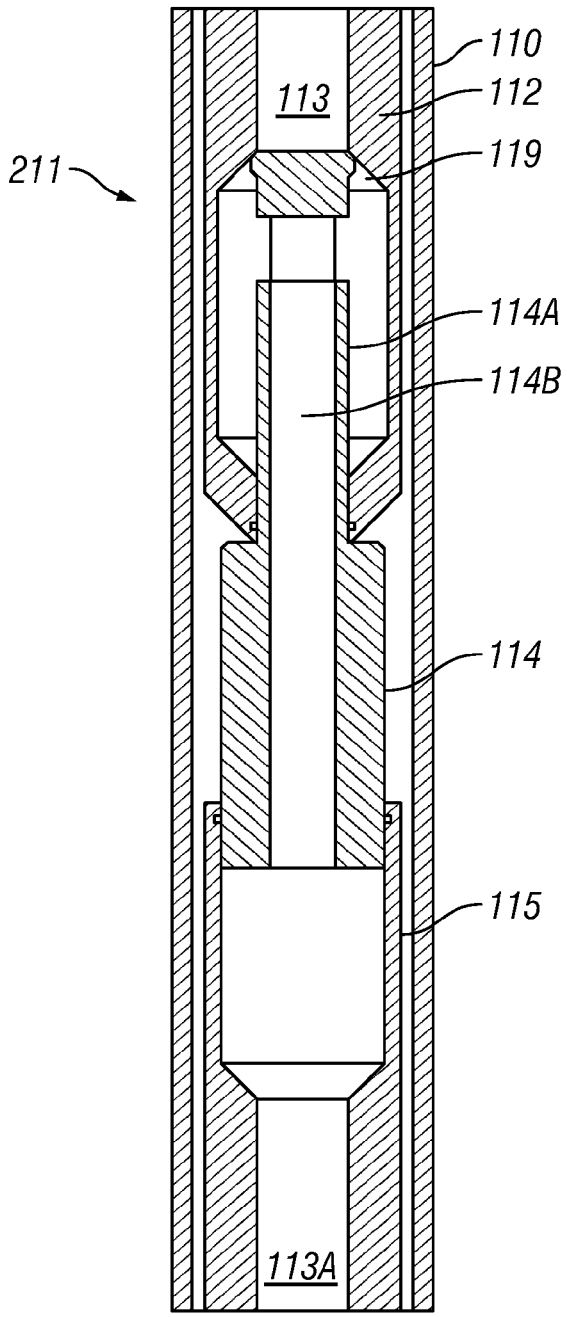
Figure 2D:
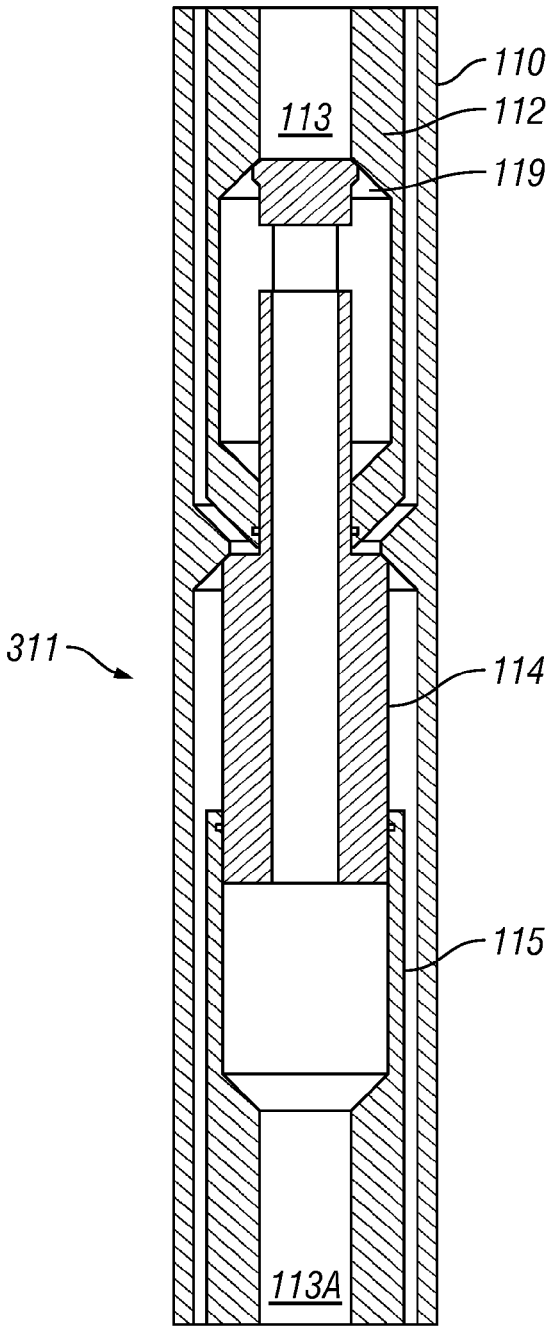
Figure 3A:
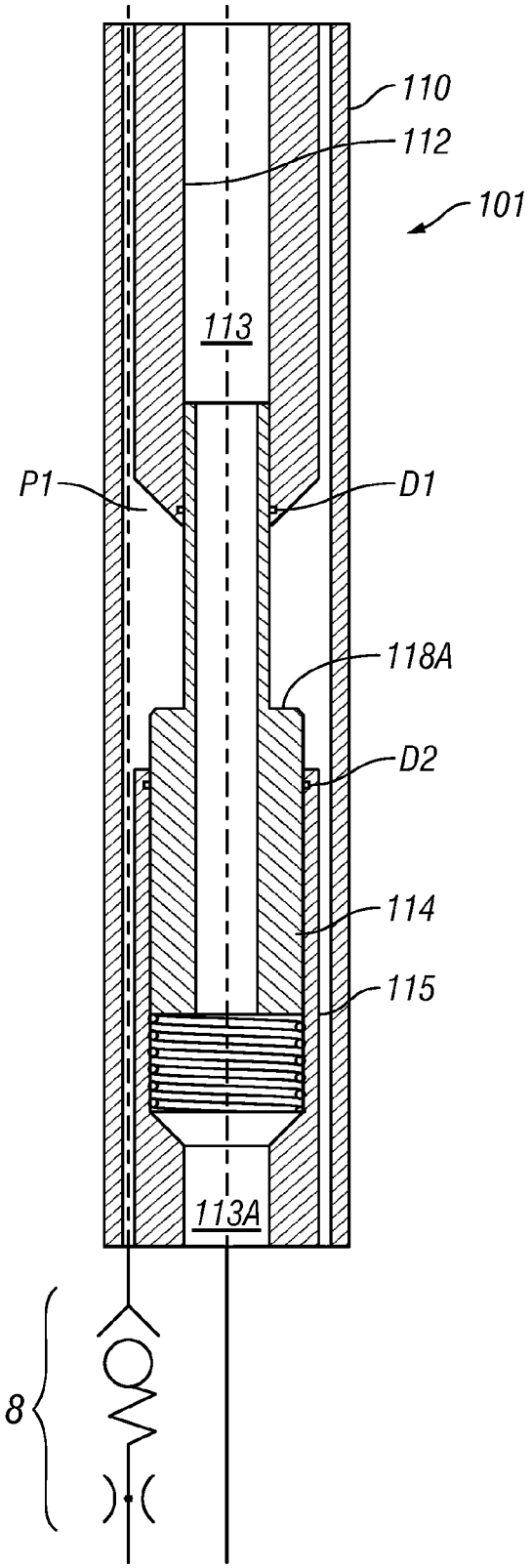
FIGS. 3A through 3D show the same examples as in FIGS. 2A through 2D, respectively, but in the open (activated) position.

The dual drill string actuators and valves 11*a*, 11*b* may be better understood with reference to FIGS. 2A through 2D and 3A through 3D. An important component of a dual drill string valve according to the invention, and referring to FIGS. 2A and 3A, is a dual drill string compatible valve actuator 101. Referring to FIG. 2A, an example dual drill string actuator 101 may be enclosed in a housing 110 that may have connections (not shown) at each longitudinal end for engaging the housing 110 to a segment of the dual drill string, e.g., 1 in FIG. 1) on one or both longitudinal ends thereof "Engagement" may include metal to metal or other form of sealing between the housing 110 and each connected segment of the outer pipe, as explained with reference to FIG. 1. "Engagement" may further include having an upper inner conduit 112 mounted in fixed longitudinal position within the housing 110. Such mounting may include, without limitation, friction fit standoffs, welding, adhesive bonding, etc. The upper inner conduit 112 may be configured to sealingly engage the inner pipe (3 in FIG. 1) to enable completion of the fluid return flow passage (5 in FIG. 1) through the actuator 101. A fluid return flow passage formed by the components of the actuator 101 is shown generally at 113 and 113A. As will be further explained below, the actuator 101 also may provide a fluid flow passage between the interior of the housing 110 and the exterior of the upper internal conduit and additional components explained below. Thus, the actuator 101 may be configured so that its behavior with respect to the dual drill string (1 in FIG. 1) is essentially "transparent", that is, the drilling rig operator or user may handle the actuator 101 in essentially the same manner as any other segment of the dual drill string (1 in FIG. 1).

In the present example, a piston 114 may be disposed inside the housing 110 and may include at one longitudinal end a tube 114A that may slidingly engage with an interior bore of the upper inner conduit 112. The tube 114A may be sealed to the upper inner conduit 112 using seals Dl of any type known in the art enabling longitudinal motion while maintaining a pressure tight seal, e.g., o-rings or the like. A lower inner conduit 115 may be mounted in the housing 110 at the opposite longitudinal end of the housing 110. The lower inner conduit may be configured at its longitudinal end to sealingly engage another segment of dual drill string such as shown in FIG. 1. The lower inner conduit 115 may be mounted inside the housing 110 in any manner as explained with reference to the upper inner conduit 112. The piston 114 may also slidingly engage the lower inner conduit 115. Such sliding engagement may include pressure tight sealing, for example, by using o-rings or similar seals such as shown at D2. Thus, the piston 114 may move longitudinally with respect to the upper 112 and lower 115 inner conduits while maintaining a sealed inner fluid passage, shown by the combination of elements 113, 114B and 113A. In the example shown in FIGS. 2A and 3A, a spring or biasing device 116 may urge the piston 114 into its raised position (FIG. 2A) in the absence of any fluid flow through the actuator 101.

The mounting of both the upper inner conduit 112 and the lower inner conduit 115 within the housing 110 may be configured to enable fluid flow in a passage formed between the interior wall of the housing 110 and the exterior of the upper inner conduit 112, the piston 114 and the lower inner conduit 115. Thus, the actuator 101 may be substantially transparent with respect to the dual drill string as it concerns fluid flow therethrough; there is provided by the described structure both an inner flow passage and an outer flow passage corresponding to such passages in the dual drill string (1 in FIG. 1). Specifically referring to FIG. 2A, the actuator 101 is shown in its state that exists when the fluid supply flow (A in FIG. 1) is stopped. The BHA 8 is shown schematically at a position below the actuator 101. The BHA 8 may include a conventional float or check valve, shown at 8A, and the lower part of the BHA 8, which may include a "mud" drilling motor (not shown) and the drill bit (7 in FIG. 1) is shown schematically at 8B as a resistance to flow therethrough. In FIG. 2A, the piston 114 is in its uppermost position. Referring to FIG. 3A, when the fluid supply flow (A in FIG. 1) is turned on, pressure P1 will exist in the passage between the interior wall of the housing 110 and the exterior of the upper inner conduit 112, the piston 114 and the lower interior conduit 115. Because of the resistance to flow provided by the BHA 8, the pressure P1 will typically be greater than the pressure below the actuator 101. The pressure P1 acts on the piston 114 to move it downwardly, as shown in FIG. 3A. The float valve 8A is shown open in FIG. 3A, which results from flow leaving the actuator 101.

The actuator 101 shown in and explained with reference to FIGS. 2A and 3A may be used in conjunction with any other apparatus disposable in a drill string. For such use, it is only necessary to provide connection such that motion of the piston 114 causes operation of another device.

It will be appreciated that the flow diverter (6 in FIG. 1) and other detailed components of the BHA 8 have been omitted from FIGS. 2A and 3A for simplicity of the illustration. In actual drilling use, such components may be included in the dual drill string as required.

Figure 3B:
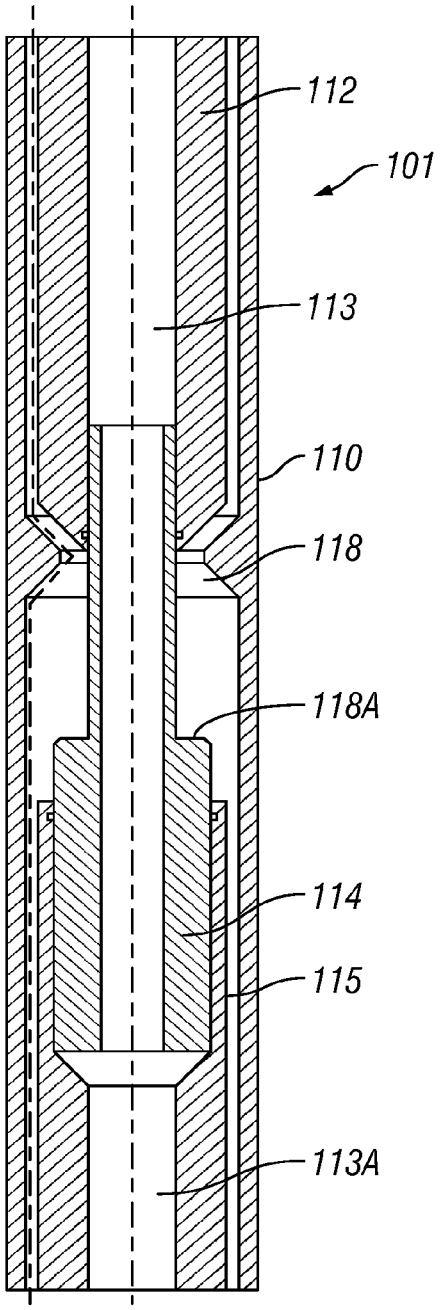

Referring to FIGS. 2B and 3B, one example of a drill string valve associated with the above described actuator will be explained. A drill string valve 111 using the actuator of FIGS. 2A and 3A may be formed by including a valve seat 118 on the base of the upper inner conduit 112. A corresponding sealing surface 118A may be provided on a part of the piston 114 that may contact the base of the upper inner conduit 112 when the piston 114 is in its uppermost position. In such configuration, the fluid passage between the interior wall of the housing 110, and the exterior of the upper inner conduit 112, the piston 114 and lower inner conduit 115 may be closed when the fluid supply flow (A in FIG. 1) is turned off. Thus, any flow from the wellbore through the supply fluid flow passage (2 in FIG. 1) may be stopped (assuming the valve 111 is connected directly to the dual drill string). FIG. 3B shows the condition of the drill string valve 111 and actuator 101 when the supply fluid flow (A in FIG. 1) is turned on. The piston 114 will be moved so that the sealing surface 118A is moved away from the valve seat 118, thus opening the foregoing fluid flow passage.

Figure 3C:
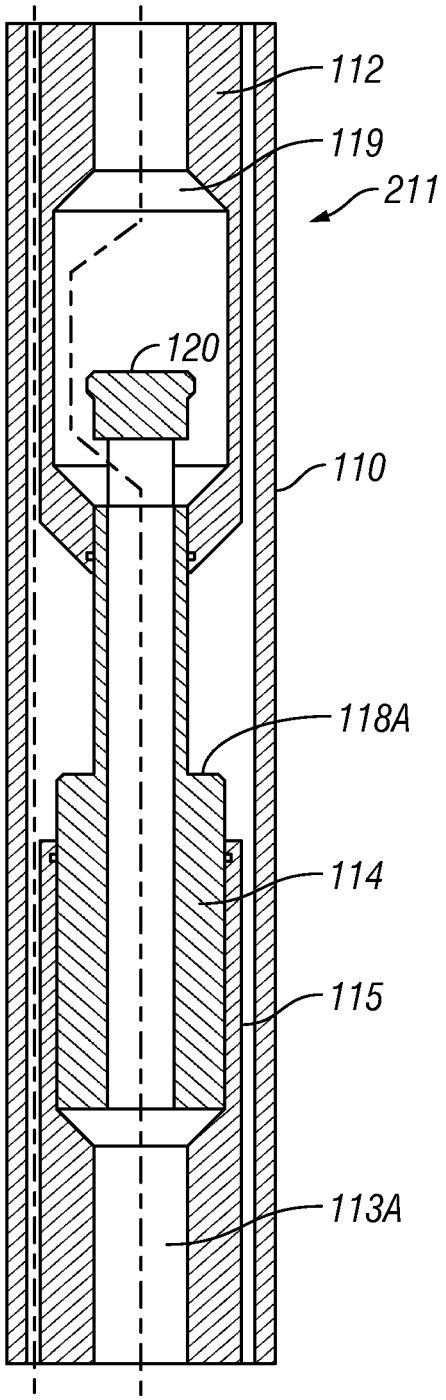

FIGS. 2C and 3C show another example of a combination actuator and dual drill string valve 211 in which the fluid flow passage internal to the upper inner conduit 112, the piston 114 and the lower inner conduit 115 can be selectively closed. Referring to FIG. 2C, the lower end of the upper inner conduit 112 may include a valve seat 119. The uppermost part of the piston 114 may include thereon a valve seal 120. When the piston 114 is in its uppermost position, e.g., when the supply fluid flow (A in FIG. 1) is turned off, the valve seal 120 may engage the valve seat 119, closing the foregoing passage to flow. FIG. 3C shows the combination actuator and drill string valve 211 in the open position, resulting from having the fluid supply flow (A in FIG. 1) turned on.

Figure 3D:
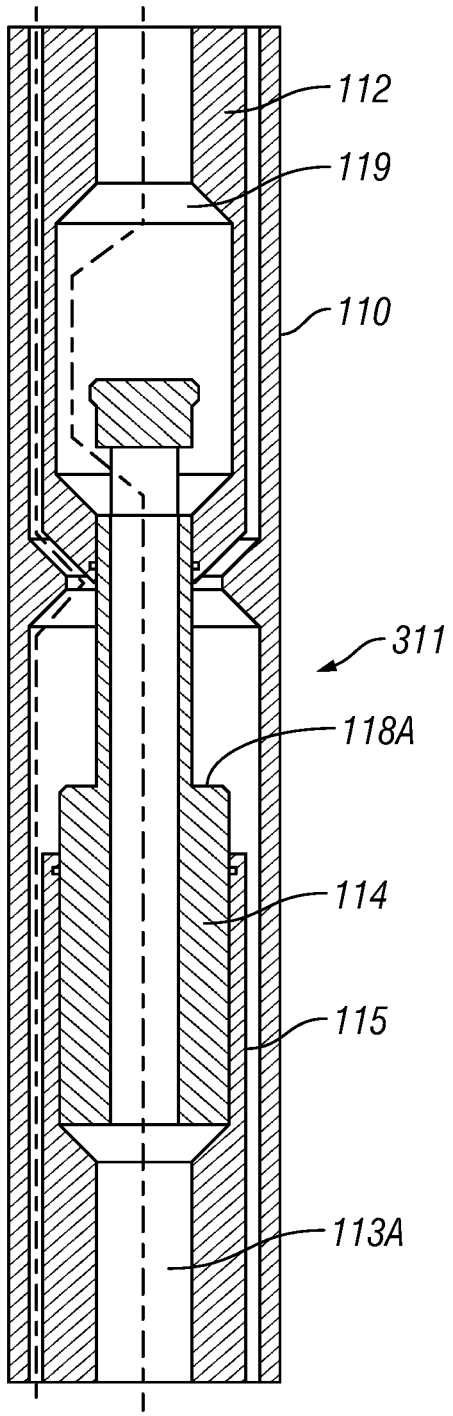

FIGS. 2D and 3D show, respectively, a combination accumulator and dual drill string valve 311 having internal components such as explained with reference to both FIGS. 2B and 3B, and 2C and 3C. The combination accumulator and dual drill string valve 311 thus provides selective closure of both the flow passage internal to and external to the upper inner conduit 112, piston 114 and lower inner conduit 115. FIG. 2D shows the dual drill string valve 311 in the closed position, while FIG. 3D shows the dual drill string valve 311 in the open position. The foregoing types of valves are not limiting; other configurations of valves may be used, e.g., flapper valves, sleeve valves, etc. provided that motion of the piston 114 is used to operate such valve(s).

FIGS. 4 through 9 show various implementations of a valve and actuator as explained with reference to FIGS. 2A-2C, and 3A-3C. In FIGS. 4 through 9, the fluid supply flow passage is indicated by numeral 4. The fluid return flow passage is indicated by numeral 5, and the wellbore annulus is indicated by numeral 9, all as used in connection with FIG. 1.

Figure 4:
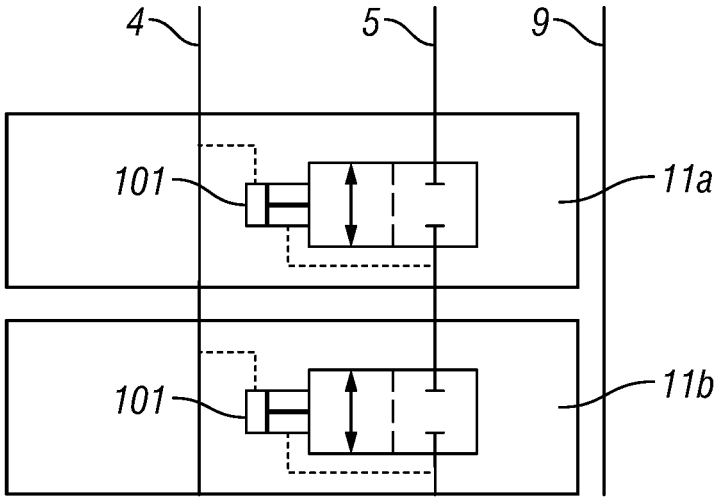
FIGS. 4, 5, 6, 7, 8 and 9 show various implementations of actuator and valve assemblies as shown in FIGS. 2A-2C and 3A-3C, including the use of conventional drill string valves below a flow diverter sub in the drill string and dual drill string valves.
Figure 5:
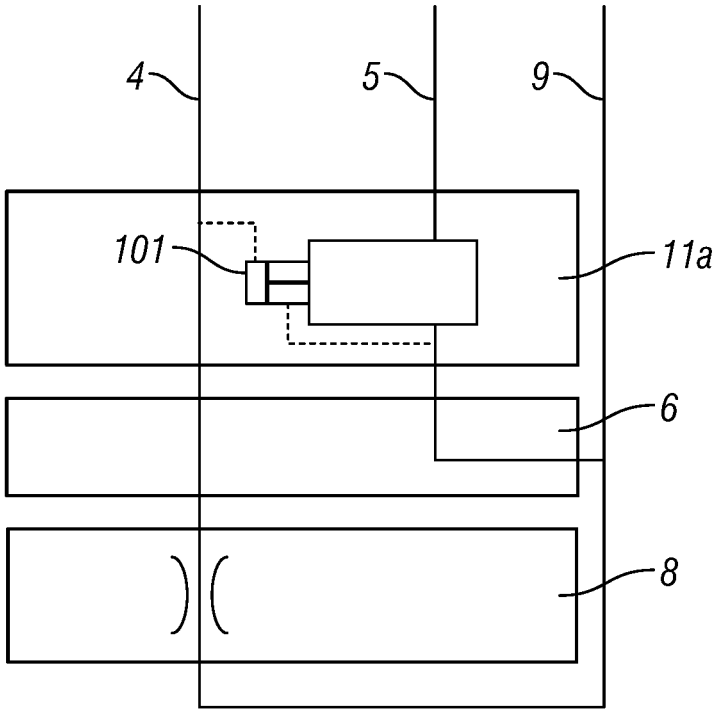

FIG. 4 shows two dual drill string valves 11*a*, 11*b* configured as explained with reference to FIGS. 2A and 3A connected in series. The dual drill string valve actuators 110 which may be piston and inner conduit assemblies as explained above, are exposed to the fluid supply flow pressure at 4, and to the fluid return flow pressure at 5. When the fluid supply flow is active, its pressure may exceed the fluid return flow pressure, causing the valve actuators 11*e* to open the respective valves 11*a*, 11*b*. Thus, fluid flow may be opened in the fluid flow return 5. Not shown in FIG. 4 is the flow diverter (6 in FIG. 1) wherein the wellbore annulus flow proximate the BHA (8 in FIG. 1) may be moved into the interior passage (5 in FIG. 1). FIG. 5 shows one dual drill string valve, configured, for example as shown in FIGS. 2 and 3, and which is configured to open and close the fluid return flow 5 when the actuator 110 is released. FIG. 5 also shows the flow diverter 6 and the BHA 8 schematically to illustrate the fluid passages therein.

Figure 6:
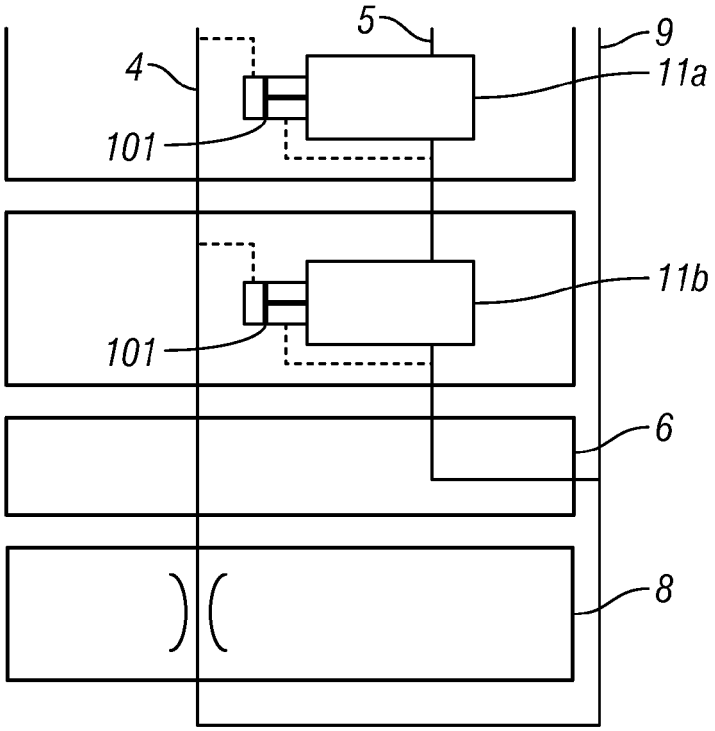

FIG. 6 shows two dual drill string valves 11*a*, 11*b* in series in a configuration similar to that shown in FIG. 5.

Figure 7:
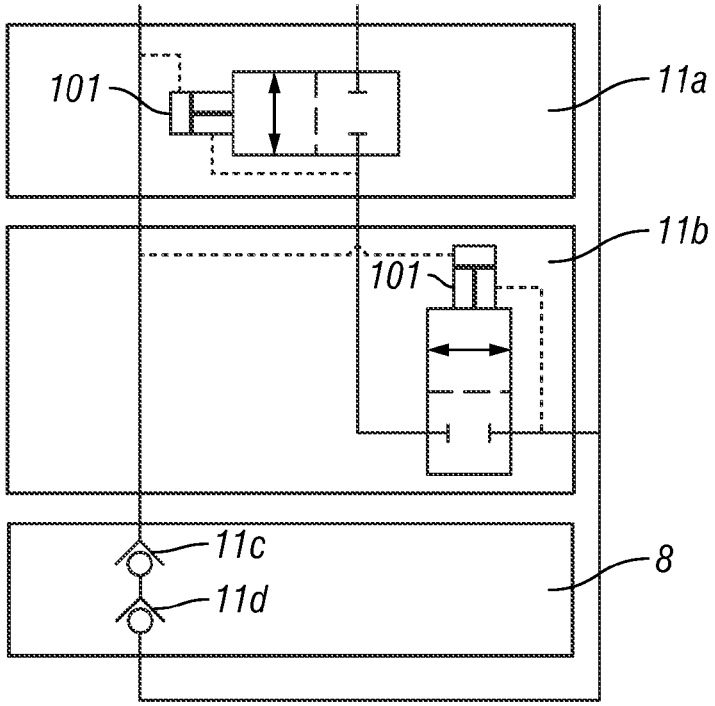

FIG. 7 shows two dual drill string valves 11*a*, 11*b* in series, but with the lower dual drill string valve 11*b* configured to selectively close flow in the fluid return passage 5, while the upper dual drill string valve 11*a* selectively closes flow in the fluid supply passage 4. The fluid supply passage, after moving through the flow diverter 6, may be stopped by ordinary drill string check valves 11*c*, 11*d* proximate the BHA 8 as described with reference to FIG. 1.

Figure 8:
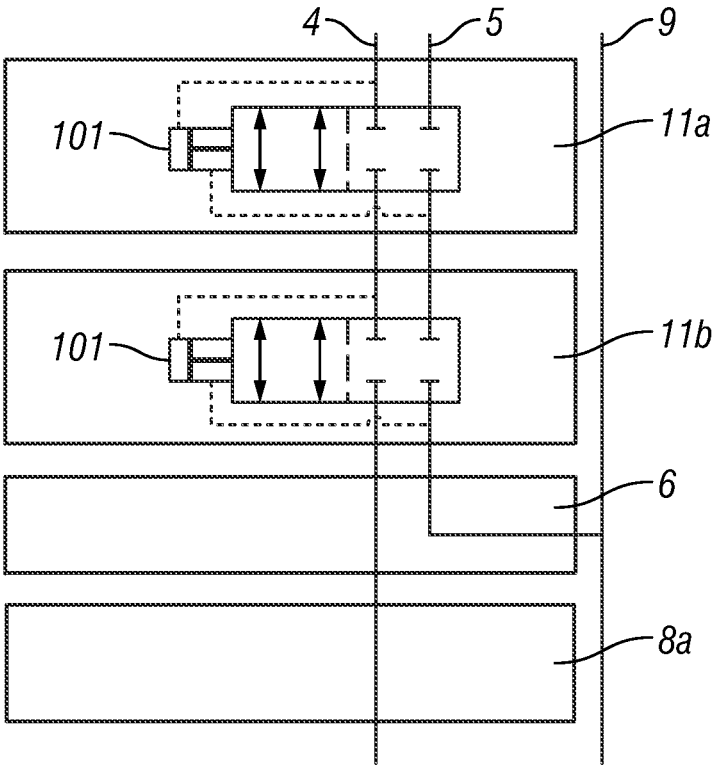

FIG. 8 shows two dual drill string valves 11*a*, 11*b* connected in series, wherein the valves 11*a* 11*b* are configured as explained with reference to FIGS. 2 and 3. The valves 11*a*, 11*b* in FIG. 8 selectively close flow to both the inner passage 5 and the outer passage 4 when the actuators 110 are operated.

Figure 9:
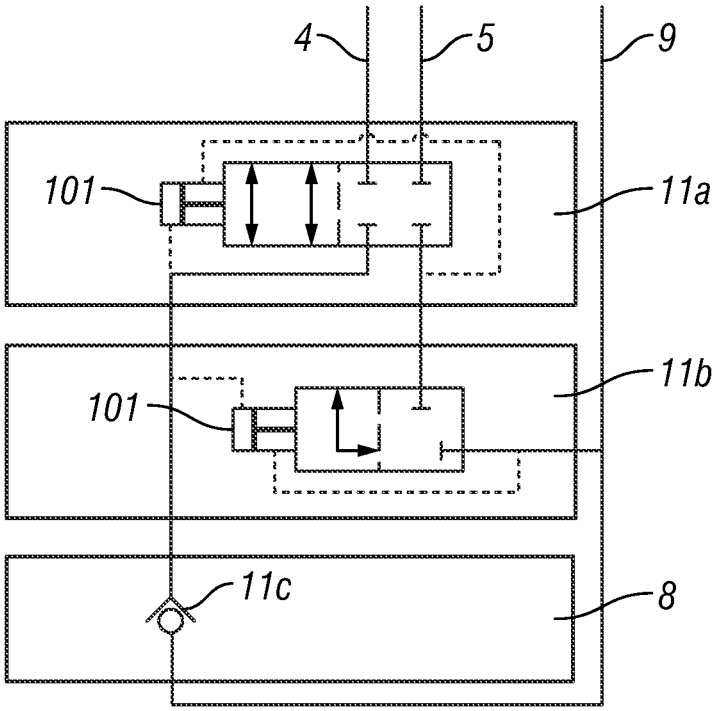

FIG. 9 shows two dual drill string valves in series, as explained with reference to FIGS. 2A and 3A, wherein the upper valve 11*a* selectively closes flow to the outer passage 4, and the lower valve 11*b* closes flow to the inner passage 5. The BHA 8 may include a conventional drill string check valve 11*c*.

Dual drill string valves according to the various aspects of the invention may provide better control over wellbore pressure and may be used more flexibly and in greater numbers of combinations that drill string valves known in the art prior to the present invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A dual drill string valve actuator, comprising:

a piston disposed in a housing, the housing configured to sealingly couple at its longitudinal ends to an end of a nested dual drill string segment;

an upper inner conduit mounted in the housing proximate one longitudinal end thereof;

a lower inner conduit mounted in the housing proximate the other longitudinal end thereof, the piston slidably, sealingly engaged between the upper and lower inner conduits and defining an internal fluid flow passage therethrough; and wherein the upper inner conduit, the piston and the lower inner conduit define an external flow passage between respective exterior surfaces thereof and an interior of the housing such that application of fluid pressure to the external flow passage causes movement of the piston away from the upper inner conduit, wherein the piston is operably coupled to at least one valve, the at least one valve arranged to selectively close fluid flow to the internal fluid flow passage.

2. The actuator of claim 1 further comprising a biasing device arranged to urge the piston to move toward the upper inner conduit.

3. The actuator of claim 2 wherein the biasing device comprises a spring.

4. The actuator of claim 1 wherein the at least one valve comprises a valve seat disposed at a longitudinal end of the upper inner conduit and a seal surface disposed on a portion of the piston, the valve seat and the seal surface configured to close the external flow passage when the piston is urged toward the upper inner conduit.

5. The actuator of claim 1 wherein the at least one valve comprises a valve seat disposed proximate one end of the upper inner conduit and a valve seal disposed on a portion of the piston slidably engaged with an interior of the upper inner conduit, wherein movement of the piston toward the upper inner conduit closes the internal flow passage to fluid flow.

6. The actuator of claim 1 further comprising a first valve seat disposed at a longitudinal end of the upper inner conduit and a seal surface disposed on a portion of the piston, the first valve seat and the seal surface configured to close the external flow passage when the piston is urged toward the upper inner conduit, a second valve seat disposed proximate one end of the upper inner conduit and a valve seal disposed on a portion of the piston slidably engaged with an interior of the upper inner conduit, wherein movement of the piston toward the upper inner conduit closes both the internal flow passage and the external passage to fluid flow.

7. A dual drill string valve actuator and valve combination comprising:

a first dual drill string valve and a second dual drill string valve coupled at selected positions within a nested dual drill string, each of the first and the second dual drill string valves comprising;

a piston disposed in a housing, the housing configured to sealingly couple at its longitudinal ends to an end of a nested dual drill string segment, an upper inner conduit mounted in the housing proximate one longitudinal end thereof, a lower inner conduit mounted in the housing proximate the other longitudinal end thereof, the piston slidably, sealingly engaged between the upper and lower inner conduits and defining an internal fluid flow passage therethrough, wherein the upper inner conduit, the piston and the lower inner conduit define an external flow passage between respective exterior surfaces thereof and an interior of the housing such that application of fluid pressure to the external flow passage causes movement of the piston away from the upper inner conduit, and a first valve seat disposed at a longitudinal end of the upper inner conduit and a seal surface disposed on a portion of the piston, the first valve seat and the seal surface configured to close the external flow passage when the piston is urged toward the upper inner conduit, a second valve seat disposed proximate one end of the upper inner conduit and a valve seal disposed on a portion of the piston slidably engaged with an interior of the upper inner conduit, wherein movement of the piston toward the upper inner conduit closes both the internal flow passage and the external passage to fluid flow.

8. A dual drill string valve, comprising:

a piston disposed in a housing, the housing configured to sealingly couple at its longitudinal ends to an end of a nested dual drill string segment;

an upper inner conduit mounted in the housing proximate one longitudinal end thereof;

a lower inner conduit mounted in the housing proximate the other longitudinal end thereof, the piston slidably, sealingly engaged between the upper and lower inner conduits and defining an internal fluid flow passage therethrough;

wherein the upper inner conduit, the piston and the lower inner conduit define an external flow passage between respective exterior surfaces thereof and an interior of the housing such that application of fluid pressure to the external flow passage causes movement of the piston away from the upper inner conduit; and a valve operably coupled to the piston, wherein the valve comprises a valve seat disposed at a longitudinal end of the upper inner conduit and a seal surface disposed on a portion of the piston, the valve seat and the seal surface configured to close the external flow passage when the piston is urged toward the upper inner conduit.

9. The dual drill string valve of claim 8 further comprising a valve seat disposed proximate one end of the upper inner conduit and a valve seal disposed on a portion of the piston slidably engaged with an interior of the upper inner conduit, wherein movement of the piston toward the upper inner conduit closes the internal flow passage to fluid flow.

10. The dual drill string valve of claim 8 further comprising a biasing device arranged to urge the piston to move toward the upper inner conduit.

11. The dual drill string valve of claim 10 wherein the biasing device comprises a spring.

* * * * *